US005366838A

United States Patent [19]

Moriya

[11] Patent Number: 5,366,838

[45] Date of Patent: Nov. 22, 1994

[54] TONER FOR ELECTROSTATIC DEVELOPMENT

[75] Inventor: Yuichi Moriya, Shizuoka, Japan

[73] Assignee: Tomoegaw Paper Co., Ltd., Tokyo, Japan

[21] Appl. No.: 15,797

[22] Filed: Feb. 10, 1993

[30] Foreign Application Priority Data

Feb. 14, 1992 [JP] Japan ..... 4-059125

[51] Int. Cl.[5] ..... G03G 9/083

[52] U.S. Cl. ..... 430/106.6; 430/108

[58] Field of Search ..... 430/106, 106.6, 108

[56] References Cited

U.S. PATENT DOCUMENTS

| | | | |
|---|---|---|---|
| 4,760,007 | 7/1988 | Takasu et al. | 430/109 |
| 5,180,650 | 1/1993 | Sacripante et al. | 430/106.6 |
| 5,202,210 | 4/1993 | Matsuoka et al. | 430/106.6 |
| 5,206,106 | 4/1993 | Moriya | 430/106.6 |

*Primary Examiner*—John Goodrow

*Attorney, Agent, or Firm*—Wenderoth, Lind & Ponack

[57] ABSTRACT

An electrostatic developer comprising a mixture of an electrically conductive magnetic toner and an insulating nonmagnetic toner, which can give excellent, fogging-free images having sufficient image density in a wide range of the electrically conductive magnetic toner/insulating nonmagnetic toner mixing ratio when used with a low-potential developing system. The electrically conductive magnetic toner is a toner which is formed by attaching or fixing a frictionally chargeable substance which is chargeable to have a polarity reverse to the polarity of the insulating nonmagnetic toner, to a surface of a main electrically conductive magnetic toner component containing 30 to 70% by weight of a magnetic powder and which has a volume specific resistance of $1\times10^{3}\Omega$.cm or less, the insulating nonmagnetic toner being a toner which is chargeable to have the same polarity as the polarity of the main electrically conductive magnetic toner component when the electrostatic developer is transferred to a photoconductive drum and which has a volume specific resistance of $1\times10^{9}\Omega$.cm or more.

8 Claims, 1 Drawing Sheet

TONER FOR ELECTROSTATIC DEVELOPMENT

FIELD OF THE INVENTION

The present invention relates to a developer for electrostatic development (electrostatic developer), and particularly to a developer suitable for use in a low-potential developing system.

PRIOR ART

In general electrophotography, a copy of an image is obtained by forming an electric latent image on a photoconductive drum, developing the latent image with a developer, transferring a developed image, i.e., an image of the developer, to a receptor such as paper, and fixing the developed image by means of heat/pressure. The developer used for the above electrophotography is largely classified into a two-component developer comprising a toner and a carrier and a one-component developer having both a toner function and a carrier function.

The one-component developer includes a magnetic one-component developer and a nonmagnetic one-component developer. As the magnetic one-component developer, there is used a magnetic developer containing approximately 10 to 70% by weight of a magnetic powder. The magnetic developer is classified into an electrically conductive magnetic developer and an insulating magnetic developer. When the electrically conductive magnetic developer is used, the development is carried out by means of electrostatic induction in which the electrically conductive magnetic developer is charged through a developing sleeve due to the electrostatic induction by a photoconductive drum. When the insulating magnetic developer is used, the development is carried out by means of tribocharge.

It is known that the one-component developing method using the electrically conductive magnetic developer has the following advantages. Since the electrically conductive magnetic developer per se constitutes an electrode for development, there can be obtained an image free of an edge effect, i.e., free from printing a central portion in a low density with marginal portions being printed in a high density. Further, when the volume-specific resistance of the electrically conductive magnetic developer is maintained around $1\times10^4\Omega$.cm or less, the developer can be applied to a low-potential developing system using a developing potential of 100 V or lower.

FIG. 1 shows a low-potential developing system suitable for use with the electrostatic developer of the present invention, in which numeral 1 indicates a photoconductive drum, numeral 2 indicates a charger, numeral 3 indicates an exposure device, numeral 4 indicates a developing device, numeral 5 indicates a transfer corona charger (transfer member), numeral 6 indicates a separating charger, and numeral 7 indicates a fixing device. While the photoconductive drum is rotated in a direction indicated by arrows, the surface of the photoconductive drum 1 is uniformly charged by means of the charger 2, and then selectively exposed by means of the exposure device 3 to form an electrostatic latent image. The developing device 4 provides the electrostatic latent image with a developer to form a developed image, and a recording sheet 10 is stacked on the photoconductive drum surface on which the developed image is retained. The transfer corona charger 5 (not shown) charges the recording sheet 10 with a polarity opposite to the polarity of the developer, and the separation charger 6 separates the recording sheet from the surface of the photoconductive drum 1. Then, the fixing device 7 fixes the developer on the recording sheet to form an image. Numeral 8 indicates a developer cleaning portion, and numeral 9 is an original image support. FIG. 1 also illustrates a series of an operation from paper feed-in to paper feed-out.

In a low-potential developing system, generally, the developing potential on the photoconductive drum is 100 V or lower, and no high-voltage device is required. No corona charging is required, and designing of the system is facilitated. Since the time required to provide the photoconductive drum surface with a potential can be decreased, the time for copying operation can be decreased or copying at a high velocity can be achieved.

However, when the electrically conductive magnetic developer is used for electrostatic transfer, the charge of the developer is liable to leak through the recording sheet, and it is difficult to transfer an image to plain paper. Further, since only a single layer of developer particles is formed on the photoconductive drum surface, the image density is low.

The above problem of charge leak can be solved to some extent by using special paper imparted with high resistance or by employing a pressure transfer method using a rubber roller. However, the above image density is essential, and the improvement in the image density by prior art is not yet satisfactory.

The present inventor has already invented a developer for electrostatic development comprising an electrically conductive toner and an insulating nonmagnetic toner (see JP-A-3-84587). This invention is aimed for achieving a sufficient image density as follows. The electrically conductive magnetic toner is attached to a photoconductive drum surface by injecting a charge into the toner through a sleeve by means of electrostatic induction by a photoconductive drum, and further, the insulating nonmagnetic toner is attached to the photoconductive drum surface by an electrostatic charge caused on the insulating nonmagnetic toner by the friction between the insulating nonmagnetic toner and a doctor blade or the electrically conductive magnetic toner.

However, it has been found that the above invention still involves the following problem. In the above invention, the amount of the electrically conductive magnetic toner attached to a photoconductive drum is not more than $\frac{1}{2}$ of the amount of the attached insulating nonmagnetic toner, since only a single layer of the electrically conductive magnetic toner is charged in a developing portion between a developing sleeve and the photoconductive drum and this single layer alone is transferred to the photoconductive drum. Therefore, the mixing ratio between the remaining electrically conductive magnetic toner and the remaining insulating nonmagnetic toner gradually differs as a large number of copies and prints are made. As a result, the image density decreases, and fogging occurs.

The above problem can be solved by adjusting the mixing ratio between the electrically conductive magnetic toner and the insulating nonmagnetic toner by means of a toner sensor. However, this solution involves problems of an increase in the cost of a system and an increase in the size of a developing device portion. It is therefore desired to develop an electrostatic developer free from a decrease in image density and fogging when the mixing ratio between the electrically conductive magnetic toner and the insulating nonmagnetic toner varies. In other words, it is desired to develop an electrostatic developer which comprises an electrically conductive magnetic toner and an insulating nonmagnetic toner, the mixing ratio of these toners being in a wide range, and which is capable of giving a sufficient image density and is free from fogging.

SUMMARY OF THE INVENTION

It is an object of the present invention to provide an electrostatic developer which comprises an electrically conductive magnetic toner and an insulating nonmagnetic toner, and which causes little change in the mixing ratio of the electrically conductive magnetic toner and insulating nonmagnetic toner.

It is another object of the present invention to provide an electrostatic developer which comprises an electrically conductive magnetic toner and an insulating nonmagnetic toner, and which gives a sufficient image density and causes little fogging when the mixing ratio of the electrically conductive magnetic toner and insulating nonmagnetic toner varies.

It is further another object of the present invention to provide an electrostatic developer which is suitable for use with a low-potential developing system.

According to the present invention, there is provided an electrostatic developer comprising a mixture of an electrically conductive magnetic toner and an insulating nonmagnetic toner, the electrically conductive magnetic toner being a toner which is formed by attaching or fixing a frictionally chargeable substance to a surface of a main electrically conductive magnetic toner component containing 30 to 70% by weight of a magnetic powder and which has a volume specific resistance of $1\times10^3\Omega$.cm or less, the insulating nonmagnetic toner being a toner which is chargeable to have the same polarity as the polarity of the main electrically conductive magnetic toner component when the electrostatic developer is transferred to a photoconductive drum and which has a volume specific resistance of $1\times10^9\Omega$.cm or more .

DETAILED DESCRIPTION OF THE INVENTION

Figure 1:
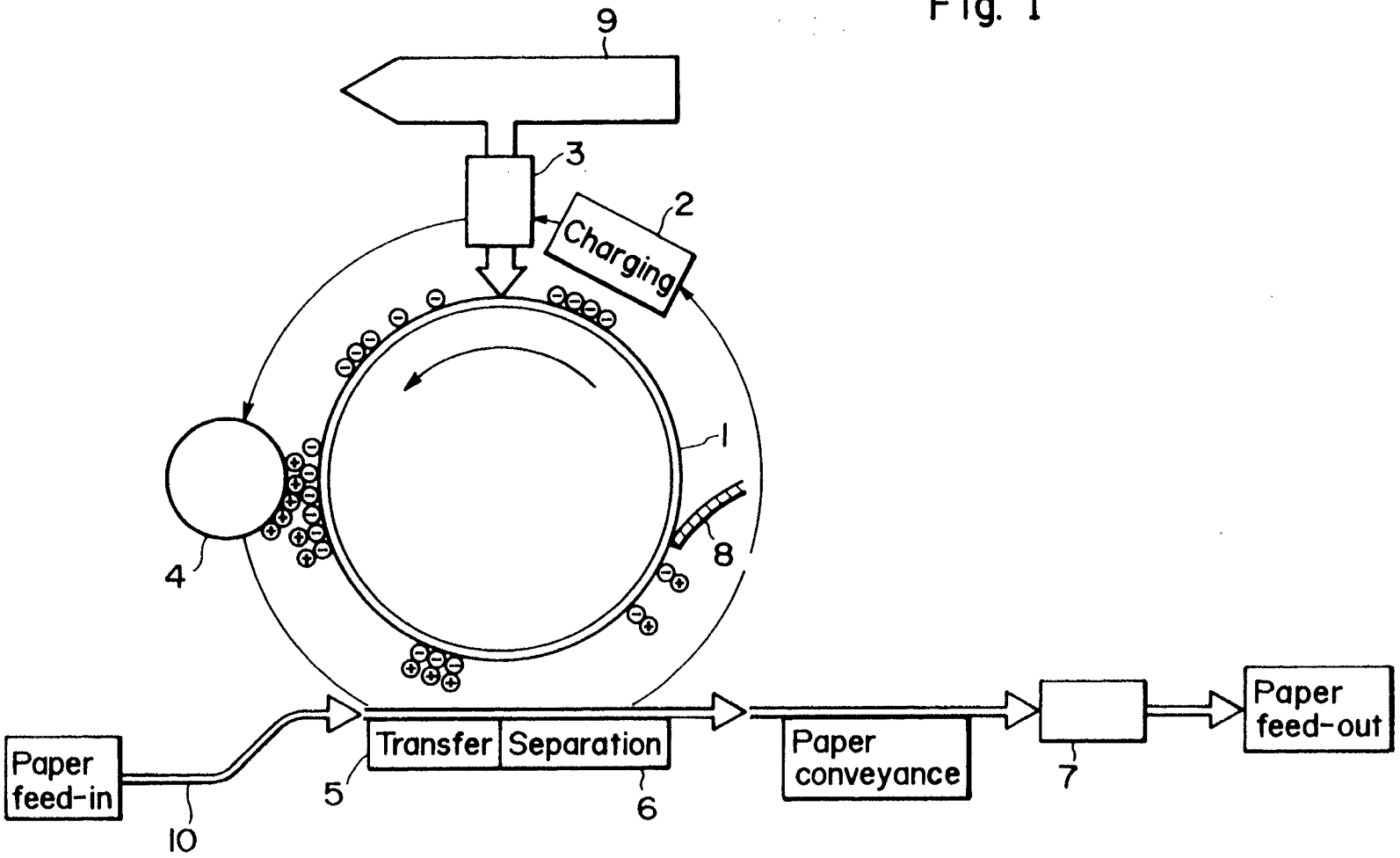
FIG. 1 shows a schematic view of a low-potential developing system.

The electrically conductive magnetic toner used in the present invention has a volume specific resistance of $1\times10^3\Omega$.cm or less. The volume specific resistance of the electrically conductive magnetic toner refers to a value obtained by measuring a sample of the electrically conductive magnetic toner under an electric field of 100 V/cm while the sample is under a load of 200 g/cm$^2$ in a cylindrical electrode whose main electrode side has an area of 1.00 cm$^2$.

The insulating nonmagnetic toner used in the present invention has a volume specific resistance of $1\times10^9\Omega$.cm or more. Differing from the volume specific resistance of the electrically conductive magnetic toner, the volume specific resistance of the insulating nonmagnetic toner cannot be measured by the above method. The volume specific resistance of the insulating nonmagnetic toner refers to a valve obtained by shaping a sample of the insulating nonmagnetic toner under a pressure of 200 kg/cm$^2$, setting the shaped sample in an SE-70 solid electrode (supplied by Ando Electric Co., Ltd.) and measuring it with a 2,500 A capacitance bridge (supplied by Andeen Hagerling Inc.).

The main electrically conductive magnetic toner component (main toner component) forming the electrically conductive magnetic toner used in the present invention is produced by dispersing a magnetic powder and a colorant such as carbon black in a binder resin, milling the resultant mixture mechanically, and classifying the milled mixture to obtain a toner having a volume average particle diameter of approximately 7 to 10 $\mu$m. The electrically conductive magnetic toner is produced by attaching or fixing a frictionally chargeable substance to the surface of the above main component. Further, an electrically conductive material such as carbon black may be attached to the toner surface to impart the electrically conductive toner surface with uniform electric conductivity. An additive such as a silica may be attached to the electrically conductive magnetic toner surface to improve the fluidity of the toner.

The above frictionally chargeable substance refers to a substance which is chargeable mainly by means of a friction between the insulting nonmagnetic toner and itself. The frictionally chargeable substance includes a substance which is positively chargeable with regard to the insulating nonmagnetic toner and a substance which is negatively chargeable with regard to the insulating nonmagnetic toner. The positively chargeable substance includes Nigrosine compounds, quaternary ammonium salts, imidazole derivatives, triphenylmethane compounds and fine resin particles whose surfaces have a positively chargeable functional group. The negatively chargeable substance includes monoazo dyes, chromium complexes of carboxylic acids, zinc complexes of carboxylic acids, polycondensation products of alkylphenols and fine resin particles whose surfaces have a negatively chargeable functional group.

The amount of the frictionally chargeable substance per 100 parts by weight of the main toner component is 0.1 to 5 parts by weight, preferably 0.5 to 2 parts by weight. When the amount of the frictionally chargeable substance is less than 0.1 parts by weight, there is little effect on improvement of the chargeability of the insulating nonmagnetic toner. When the above amount exceeds 5 parts by weight, fogging occurs since there occurs a frictionally chargeable substance which adheres or does not adhere to the electrically conductive magnetic toner.

In the present invention, the main electrically conductive magnetic toner component is composed mainly of a binder resin and a magnetic powder. The binder resin includes thermoplastic resins such as polystyrene, polyethylene, polypropylene, a vinyl resin, polyacrylate, polymethacrylate, polyvinylidene chloride, polyacrylontrile, polyether, polycarbonate, thermoplastic polyester, a thermoplastic epoxy resin, a cellulose resin and copolymer resins of these, and thermosetting resins such as a modified acrylic resin, a phenolic resin, a melamine resin and a urea resin. The magnetic powder includes ferrite and magnetite having the crystallographic structure of spinel, perovskite, a hexagonal system, garnet or orthoferrite. Ferrite has the structure of a sintered body formed from oxide of nickel, zinc, manganese, magnesium, copper, lithium, barium, vanadium, chromium or calcium and trivalent iron oxide.

The main electrically conductive magnetic toner component may contain a colorant such as carbon black.

In the present invention, the frictionally chargeable substance can be attached to the surface of the electrically conductive magnetic toner by mixing the frictionally chargeable substance and the electrically conductive magnetic toner with a generally used mixer such as a turbine mixer or a Henschel mixer. Further, the frictionally chargeable substance can be fixed to the surface of the electrically conductive magnetic toner by exerting mechanical impact with a turbine mixer or a Henschel mixer for a long period of time with heating. This fixing can be more effectively carried out with a surface modifying apparatus such as a Nara Hybridization system (supplied by Nara Machinery Co., Ltd.).

The insulating nonmagnetic toner used in the present invention is produced by dispersing a colorant such as carbon black and a charge control agent in a binder resin, milling the resultant mixture and classifying the milled product. The insulating nonmagnetic toner may be also produced as a toner having a desired particle diameter by dispersing carbon black and a charge control agent while a binder resin is polymerized. Further, carbon black may be attached to the surface of the so-obtained toner particles, for example, by dispersing the carbon black in the toner particles for resistance adjustment, and an additive such as silica may be attached to the surface of the so-obtained toner particles for improving the fluidity of the toner particles. The above carbon black and/or additive are/is used preferably in an amount of 0.05 to 1 part by weight.

In the present invention, the binder resin used for producing the insulating nonmagnetic toner is properly selected from those binder resins described regarding the electrically conductive magnetic toner. Further, the charge control agent may be selected from dyes such as monoazo metal dyes and Nigrosine dyes and quaternary ammonium salts as required.

The carbon black which may be attached to the surface of the insulating nonmagnetic toner is not specially limited concerning specific surface area, oil absorption and pH. Examples of the carbon black include commercially available products such as Regal 400R, 660R and 330R supplied by U.S. Cabot, Raven 410, 420, 430 and 450 supplied by Columbia Carbon Japan and Carbon Black #40, #2400 and MA-100 supplied by Mitsubishi Kasei Corp. These products may be used alone or in combination.

Carbon black and silica can be attached to the surface of the insulating nonmagnetic toner used in the present invention by means of a generally used mixer such as a turbine stirrer, a super mixer or a Henschel mixer.

The electrostatic developer of the present invention comprises the electrically conductive magnetic toner and the insulating nonmagnetic toner. The electrically conductive magnetic toner is chargeable in a developing portion through a developing sleeve due to electrostatic induction. When the electrically conductive magnetic toner is charged as above, and when the electrostatically attractive force between a latent image portion on a photoconductive drum and the electrically conductive magnetic toner is made greater than the magnetically constraining force between a developing sleeve and the electrically conductive magnetic toner, the electrically conductive magnetic toner adheres to the latent image portion to form a developed image. On the other hand, the insulating nonmagnetic toner is chargeable under friction among itself, a doctor blade and the electrically conductive magnetic toner. When charged, the insulating nonmagnetic toner is transferred to the latent image portion. As a result, a large amount of a mixture of the electrically conductive magnetic toner and the insulating nonmagnetic toner adheres to the latent image portion on a photoconductive drum. Therefore, a sufficient image density can be obtained.

In the present invention, the electrically conductive magnetic toner and the insulating nonmagnetic toner are mixed and stirred in a developing device, and a brush of the electrically conductive magnetic toner is formed on a developing sleeve by means of a magnetic roller mounted in the developing sleeve. For this purpose, the amount of the magnetic powder contained in the main electrically conductive magnetic toner component is required to be 30 to 70% by weight. When the amount of the magnetic powder is less than 30% by weight, the magnetic force of the resultant electrically conductive magnetic toner is not sufficient for forming an adequate brush, and the electrically conductive magnetic toner cannot be sufficiently carried by a developing sleeve. When the above amount exceeds 70% by weight, not only it is difficult to disperse the magnetic powder in the binder resin, but also it is difficult to obtain adequate electric conductivity since the amount of the electrically conductive material such as carbon black is relatively small.

The insulating nonmagnetic toner adheres to the electrically conductive magnetic toner due to an electrostatic force caused by friction-induced charge, and it is carried together with the electrically conductive magnetic toner to a developing portion formed between a photoconductive drum and a developing sleeve. The electrically conductive magnetic toner/insulating nonmagnetic toner mixing ratio is preferably 60/40 to 85/15 (by weight). When the proportion of the insulating nonmagnetic toner exceeds 40 parts by weight per 100 parts by weight of the electrically conductive magnetic toner and the insulating nonmagnetic toner in total, the insulating nonmagnetic toner cannot be sufficiently carried together with the electrically conductive magnetic toner. When the proportion of the insulating nonmagnetic toner is less than 15 parts by weight based on the above standard, it is difficult to obtain a sufficient image density.

In the present invention, the frictionally chargeable substance is attached or fixed to the surface of the electrically conductive magnetic toner. Due to the use of such an electrically conductive magnetic toner, the electrically conductive magnetic toner and the insulating nonmagnetic toner exhibit improved chargeability. That is, the insulating nonmagnetic toner frictionally contacts the frictionally chargeable substance attached or fixed to the surface of the electrically conductive magnetic toner, and the amount of charge of the insulating nonmagnetic toner increases. At the same time, the amount of the insulating nonmagnetic toner not charged relatively decreases. For this reason, a practical image density can be obtained even when the proportion of the insulating nonmagnetic toner is as low as 15 parts by weight, and an excellent image showing little fogging can be obtained even when the proportion of the insulating nonmagnetic toner is relatively high, as high as 40 parts by weight.

When the volume specific resistance of the electrically conductive magnetic toner is greater than $1\times10^3\Omega$.cm, the volume specific resistance of the resultant electrostatic developer is too high to carry out the low-potential development. When the volume specific resistance of the insulating nonmagnetic toner is lower than $1\times10^9$.cm, insufficient frictional charge can be obtained due to charge leakage. As a result, the image density decreases.

The present invention will be explained greater in detail by reference to Examples, in which "part" stands for "part by weight".

EXAMPLES 1–4

| | |
|---|---|
| Epoxy resin (Epikote 1004, supplied by Yuka-Shell Epoxy K.K.) | 46 parts |
| Polypropylene (Viscol 660P, supplied by Sanyo Chemical Industries, Ltd.) | 2 parts |
| Magnetite (KBC-100, supplied by Kanto Denka Kogyo Co., Ltd.) | 40 parts |
| Carbon black (Ketjen Black EC, supplied by Lion Akzo Co., Ltd.) | 12 parts |

The above materials were melt-kneaded with a two-roll kneader and milled with a jet mill, and the resultant product was classified to obtain a main electrically conductive magnetic toner component particles having a volume average particle diameter of 9 μm. Then, 1 part of a Nigrosine dye (Nigrosine base EX, supplied by Orient Chemical Industrial Co., Ltd.) was mixed with 100 parts of the above particles with a Henschel mixer (supplied by Mitsui-Miike Engineering Co., Ltd.). Then, 0.8 part, per 100 parts of the above-obtained mixture, of carbon black (Ketjen Black EC, supplied by Lion Akzo Co., Ltd.) was mixed with the mixture to give an electrically conductive magnetic toner. This electrically conductive magnetic toner had a volume specific resistance of $3.5\times10^2\Omega$.cm.

| | |
|---|---|
| Styrene acrylic resin (Mw = 120,000, Mn = 6,000, Mw/Mn = 20) | 90 parts |
| Polypropylene (Viscol 660P, supplied by Sanyo Chemical Industries, Ltd.) | 3 parts |
| Carbon black (Ma-100, supplied by Mitsubishi Kasei Corp.) | 5 parts |
| Chromium complex dye (Bontron S-44, supplied by Orient Chemical Industrial Co., Ltd.) | 2 parts |

The above materials were melt-kneaded with a two-roll kneader and milled with a jet mill, and the resultant product was classified to obtain toner particles having a volume average particle diameter of 10 μm. Then, 1 part of carbon black (MA-100, supplied by Mitsubishi Kasei Corp.) was mixed with 100 parts by weight of the above particles with a Henschel mixer (supplied by Mitsui-Miike Engineering Co., Ltd.) to give an insulating nonmagnetic toner. This insulating nonmagnetic toner had a volume specific resistance of $3\times10^{10}\Omega$.cm.

The above-obtained electrically conductive magnetic toner and insulating nonmagnetic toner were mixed in predetermined mixing ratios to prepare electrostatic developers of Examples 1 to 4.

EXAMPLES 5–8

| | |
|---|---|
| Epoxy resin (Epikote 1004, supplied by Yuka-Shell Epoxy K.K.) | 46 parts |
| Polypropylene (Viscol 660P, supplied by Sanyo Chemical Industires, Ltd.) | 2 parts |

-continued

| | |
|---|---|
| Magnetite (KBC-100, supplied by Kanto Denka Kogyo Co., Ltd.) | 40 parts |
| Carbon black (Ketjen Black EC, supplied by Lion Akzo Co., Ltd.) | 12 parts |

The above materials were melt-kneaded with a two-roll kneader and milled with a jet mill, and the resultant product was classified to obtain main electrically conductive magnetic toner component particles having a volume average particle diameter of 9 μm. Then, 1 part of a Nigrosine dye (Nigrosine base EX, supplied by Orient Chemical Industrial Co., Ltd.) was mixed with 100 parts of the above particles, and the resultant mixture was placed in a Nara hybridization system (NHS-3, supplied by Nara Machinery Co., Ltd.) and treated at 6,000 rpm for 3 minutes. Then, 0.8 part, per 100 parts of the above-obtained treated mixture, of carbon black (Ketjen Black EC, supplied by Lion Akzo Co., Ltd.) was mixed with the above-treated mixture with a Henschel mixer (supplied by Mitsui Miike Engineering Co., Ltd.) to give an electrically conductive magnetic toner. This electrically conductive magnetic toner had a volume specific resistance of $4\times10^2\Omega$.cm.

| | |
|---|---|
| Styrene acrylic resin (Mw = 120,000, Mn = 6,000, Mw/Mn = 20) | 87 parts |
| Polypropylene (Viscol 660P, supplied by Sanyo Chemical Industries, Ltd.) | 3 parts |
| Carbon black (#40, supplied by Mitsubishi Kasei Corp.) | 5 parts |
| Chromium complex dye (Bontrol S-44, supplied by Orient Chemical Industrial Co., Ltd.) | 2 parts |

The above materials were melt-kneaded with a two-roll kneader and milled with a jet mill, and the resultant product was classified to obtain toner particles having a volume average particle diameter of 10 μm. Then, 0.5 part of carbon black (MA-100, supplied by Mitsubishi Kasei Corp.) was mixed with 100 parts by weight of the above particles with a Henschel mixer (supplied by Mitsui Miike Engineering Co., Ltd.) to give an insulating nonmagnetic toner. This insulating nonmagnetic toner had a volume specific resistance of $9\times10^9\Omega$.cm.

The above-obtained electrically conductive magnetic toner and insulating nonmagnetic toner were mixed in predetermined mixing ratios to prepare electrostatic developers of Examples 5 to 8.

EXAMPLES 9–12

| | |
|---|---|
| Epoxy resin (Epikote 1004, supplied by Yuka Shell Epoxy K.K.) | 46 parts |
| Polypropylene (Viscol 660P, supplied by Sanyo Chemical Industries, Ltd.) | 2 parts |
| Magnetite (KBC-100, supplied by Kanto Denka Kogyo Co., Ltd.) | 40 parts |
| Carbon black (Ketjen Black EC, supplied by Lion Akzo Co., Ltd.) | 12 parts |

The above materials were melt-kneaded with a two-roll kneader and milled with a jet mill, and the resultant product was classified to obtain main electrically conductive magnetic toner component particles having a volume average particle diameter of 9 μm. Then, 1 part of a chromium complex dye (Bontron S-44, supplied by Orient Chemical Industrial Co., Ltd.) was mixed with 100 parts of the above particles with a Henschel mixer (supplied by Mitsui Miike Engineering Co., Ltd.). Then, 0.8 part, per 100 parts of the above-obtained mixture, of carbon black (Ketjen Black EC, supplied by Lion Akzo Co., Ltd.) was mixed with the mixture to give an electrically conductive magnetic toner. This electrically conductive magnetic toner had a volume specific resistance of $3\times10^{2}\Omega$.cm.

| | |
|---|---|
| Sytrene acrylic resin (Mw = 120,000, Mn = 6,000, Mw/Mn = 20) | 90 parts |
| Polypropylene (Viscol 660P, supplied by Sanyo Chemical Industries, Ltd.) | 3 parts |
| Carbon black (Ma-100, supplied by Mitsubishi Kasei Corp.) | 5 parts |
| a Nigrosine dye (Nigrosine base EX, supplied by Orient Chemical Industrial Co., Ltd.) | 2 parts |

The above materials were melt-kneaded with a two-roll kneader and milled with a jet mill, and the resultant product was classified to obtain toner particles having a volume average particle diameter of 10 μm. Then, 1 part of carbon black (MA-100, supplied by Mitsubishi Kasei Corp.) was mixed with 100 parts by weight of the above particles with a Henschel mixer (supplied by Mitsui Miike Engineering Co., Ltd.) to give an insulating nonmagnetic toner. This insulating nonmagnetic toner had a volume specific resistance of $3\times10^{10}\Omega$.cm.

The above-obtained electrically conductive magnetic toner and insulating nonmagnetic toner were mixed in predetermined mixing ratios to prepare electrostatic developers of Examples 9 to 12.

EXAMPLES 13–16

| | |
|---|---|
| Epoxy resin (Epikote 1004, supplied by Yuka Shell Epoxy K.K.) | 46 parts |
| Polypropylene (Viscol 660P, supplied by Sanyo Chemical Industries, Ltd.) | 2 parts |
| Magnetite (KBC-100, supplied by Kanto Denka Kogyo Co., Ltd.) | 40 parts |
| Carbon black (Ketjen Black EC, supplied by Lion Akzo Co., Ltd.) | 12 parts |

The above materials were melt-kneaded with a two-roll kneader and milled with a jet mill, and the resultant product was classified to obtain main electrically conductive magnetic toner component particles having a volume average particle diameter of 9 μm. Then, 1 part of a chromium complex dye (Bontron S-44, supplied by Orient Chemical Industrial Co., Ltd.) was mixed with 100 parts of the above particles, and the resultant mixture was placed in a Nara hybridization system (NHS-3, supplied by Nara Machinery Co., Ltd.) and treated at 6,000 rpm for 3 minutes. Then, 0.8 part, per 100 parts of the above-obtained treated mixture, of carbon black (Ketjen Black EC, supplied by Lion Akzo Co., Ltd.) was mixed with the above-treated mixture with a Henschel mixer (supplied by Mitsui Miike Engineering Co., Ltd.) to give an electrically conductive magnetic toner. This electrically conductive magnetic toner had a volume specific resistance of $6\times10^{2}\Omega$.cm.

| | |
|---|---|
| Styrene acrylic resin (Mw = 120,000, Mn = 6,000, Mw/Mn = 20) | 87 parts |

-continued

| | |
|---|---|
| Polypropylene (Viscol 660P, supplied by Sanyo Chemical Industries, Ltd.) | 2 parts |
| Carbon black (#40, supplied by Mitsubishi Kasei Corp.) | 9 parts |
| Nigrosine dye (Nigrosine base EX, supplied by Orient Chemical Industrial Co., Ltd.) | 2 parts |

The above materials were melt-kneaded with a two-roll kneader and milled with a jet mill, and the resultant product was classified to obtain toner particles having a volume average particle diameter of 10 μm. Then, 0.5 part of carbon black (MA-100, supplied by Mitsubishi Kasei Corp.) was mixed with 100 parts by weight of the above particles with a Henschel mixer (supplied by Mitsui Miike Engineering Co., Ltd.) to give an insulating nonmagnetic toner. This insulating nonmagnetic toner had a volume specific resistance of $8\times10^{9}\Omega$.cm.

The above-obtained electrically conductive magnetic toner and insulating nonmagnetic toner were mixed in predetermined mixing ratios to prepare electrostatic developers of Examples 13 to 16.

Comparative Examples 1–4

| | |
|---|---|
| Epoxy resin (Epikote 1004, supplied by Yuka Shell Epoxy K.K.) | 52 parts |
| Polypropylene (Viscol 660P, supplied by Sanyo Chemical Industries, Ltd.) | 2 parts |
| Magnetite (KBC-100, supplied by Kanto Denka Kogyo Co., Ltd.) | 40 parts |
| Carbon black (Ketjen Black EC, supplied by Lion Akzo Co., Ltd.) | 6 parts |

The above materials were melt-kneaded with a two-roll kneader and milled with a jet mill, and the resultant product was classified to obtain main electrically conductive magnetic toner component particles having a volume average particle diameter of 9 μm. Then, 1 part of a Nigrosine dye (Nigrosine base EX, supplied by Orient Chemical Industrial Co., Ltd.) was mixed with 100 parts of the above particles with a Henschel mixer (supplied by Mitsui Miike Engineering Co., Ltd.). Then, 0.8 part, per 100 parts of the above-obtained mixture, of carbon black (Ketjen Black EC, supplied by Lion Akzo Co., Ltd.) was mixed with the mixture to give an electrically conductive magnetic toner. This electrically conductive magnetic toner had a volume specific resistance of $7\times10^{4}\Omega$.cm.

The above-obtained electrically conductive magnetic toner and the same insulating nonmagnetic toner as that obtained in Example 1 were mixed in predetermined mixing ratios to prepare electrostatic developers of Comparative Examples 1 to 4.

Comparative Examples 5–8

| | |
|---|---|
| Epoxy resin (Epikote 1004, supplied by Yuka Shell Epoxy K.K.) | 46 parts |
| Polypropylene (Viscol 660P, supplied by Sanyo Chemical Industries, Ltd.) | 2 parts |
| Magnetite (KBC-100, supplied by Kanto Denka Kogyo Co., Ltd.) | 40 parts |
| Carbon black (Ketjen Black EC, supplied by Lion Akzo Co., Ltd.) | 12 parts |

The above materials were melt-kneaded with a two-roll kneader and milled with a jet mill, and the resultant product was classified to obtain main electrically conductive magnetic toner component particles having a volume average particle diameter of 9 μm. Then, 0.8 part of carbon black (Ketjen Black EC, supplied by Lion Akzo Co., Ltd.) was mixed with 100 parts of the above particles with a Henschel mixer (supplied by Mitsui Miike Engineering Co., Ltd.) to give an electrically conductive magnetic toner. This electrically conductive magnetic toner had a volume specific resistance of $3\times10^2\Omega$.cm.

The above-obtained electrically conductive magnetic toner and the same insulating nonmagnetic toner as that obtained in Example 1 were mixed in predetermined mixing ratios to prepare electrostatic developers of comparative Examples 5 to 8.

Comparative Examples 9–12

| | |
|---|---|
| Epoxy resin (Epikote 1004, supplied by Yuka Shell Epoxy K.K.) | 52 parts |
| Polypropylene (Viscol 660P, supplied by Sanyo Chemical Industries, Ltd.) | 2 parts |
| Magnetite (KBC-100, supplied by Kanto Denka Kogyo Co., Ltd.) | 40 parts |
| Carbon black (Ketjen Black EC, supplied by Lion Akzo Co., Ltd.) | 6 parts |

The above materials were melt-kneaded with a two-roll kneader and milled with a jet mill, and the resultant product was classified to obtain main electrically conductive magnetic toner component particles having a volume average particle diameter of 9 μm. Then, 1 part of a chromium complex dye (Bontron S-44, supplied by Orient Chemical Industrial Co., Ltd.) was mixed with 100 parts of the above particles, and the resultant mixture was placed in a Nara hybridization system (NHS-3, supplied by Nara Machinery Co., Ltd.) and treated at 6,000 rpm for 3 minutes. Then, 0.8 part, per 100 parts of the above-obtained treated mixture, of carbon black (Ketjen Black EC, supplied by Lion Akzo Co., Ltd.) was mixed with the above-treated mixture with a Henschel mixer (supplied by Mitsui Miike Engineering Co., Ltd.) to give an electrically conductive magnetic toner. This electrically conductive magnetic toner had a volume specific resistance of $2\times10^5\Omega$.cm.

The above-obtained electrically conductive magnetic toner and the same insulating nonmagnetic toner as that obtained in Example 9 were mixed in predetermined mixing ratios to prepare electrostatic developers of Comparative Examples 9 to 12.

Comparative Examples 13–16

The same electrically conductive magnetic toner as that obtained in Comparative Example 5 and the same insulating nonmagnetic toner as that obtained in Example 9 were mixed in predetermined mixing ratios to obtain electrostatic developers of Comparative Examples 13 to 16.

The developers obtained in Examples 1 to 16 and Comparative Examples 1 to 16 were used as follows to make copies, and the copies were measured for image density and fogging value to determine a range of the toner mixing ratio allowable in practical use (in which the image density is at least 1.0 and the fogging value is 0.010 or less).

That is, the developers obtained in Examples 1 to 8 and Comparative Examples 1 to 8 were used to make copies with an LED reversal development printer having a negatively charged photoconductive drum and working at a developing potential of 40 V. The developers obtained in Examples 9 to 16 and Comparative Examples 9 to 16 were used to make copies with an LED reversal development printer having a positively charged photoconductive drum and working at a developing potential of 40 V. These copies were measured for image density with a Macbeth RD914 densitometer, and also measured for fogging value with a reflectometer TC-6D (supplied by Tokyo Denshoku Co., Ltd.).

TABLE

| Sample | Mixing ratio (A:B) | Image density | Fogging value | mixing ratio range allowable in pratical use |
|---|---|---|---|---|
| Ex. 1 | 90:10 | 0.67 | 0.004 | 85:15–60:40 |
| Ex. 2 | 85:15 | 1.01 | 0.004 | |
| Ex. 3 | 60:40 | 1.30 | 0.010 | |
| Ex. 4 | 55:45 | 1.27 | 0.105 | |
| Ex. 5 | 90:10 | 0.72 | 0.005 | 85:15–65:35 |
| Ex. 6 | 85:15 | 1.03 | 0.006 | |
| Ex. 7 | 65:35 | 1.30 | 0.010 | |
| Ex. 8 | 60:40 | 1.30 | 0.121 | |
| Ex. 9 | 90:10 | 0.60 | 0.004 | 85:15–65:35 |
| Ex. 10 | 85:15 | 1.02 | 0.004 | |
| Ex. 11 | 65:35 | 1.26 | 0.009 | |
| Ex. 12 | 60:40 | 1.25 | 0.096 | |
| Ex. 13 | 90:10 | 0.61 | 0.005 | 85:15–65:35 |
| Ex. 14 | 85:15 | 1.00 | 0.004 | |
| Ex. 15 | 65:35 | 1.27 | 0.010 | |
| Ex. 16 | 60:40 | 1.25 | 0.112 | |
| CEx. 1 | 85:15 | 0.71 | 0.005 | 80:20–75:25 |
| CEx. 2 | 80:20 | 1.04 | 0.006 | |
| CEx. 3 | 75:25 | 1.09 | 0.010 | |
| CEx. 4 | 70:30 | 0.96 | 0.228 | |
| CEx. 5 | 85:15 | 0.84 | 0.005 | 80:20–70:30 |
| CEx. 6 | 80:20 | 1.02 | 0.005 | |
| CEx. 7 | 70:30 | 1.18 | 0.010 | |
| CEx. 8 | 65:35 | 1.00 | 0.161 | |
| CEx. 9 | 85:15 | 0.60 | 0.004 | 80:20–75:25 |
| CEx. 10 | 80:20 | 1.01 | 0.004 | |
| CEx. 11 | 75:25 | 1.10 | 0.009 | |
| CEx. 12 | 70:30 | 1.02 | 0.152 | |
| CEx. 13 | 85:15 | 0.82 | 0.004 | 80:20–70:30 |
| CEx. 14 | 80:20 | 1.03 | 0.005 | |
| CEx. 15 | 70:30 | 1.22 | 0.010 | |
| CEx. 16 | 65:35 | 1.21 | 0.083 | |

Notes: Ex. = Example, CEx, = Comparative Example
A = Electrically conductive magnetic toner
B = Insulating nonmagnetic toner
Mixing ratio range allowable in practical use = range where the image density is at least 1.0 and the fogging value is 0.010 or less.

The results in the above Table clearly show that the range of the electrically conductive magnetic toner/insulating nonmagnetic toner mixing ratio where the electrostatic developer of the present invention can give excellent, fogging-free images having a sufficient image density is wider than the range of the mixing ratio where any one of the developers of the Comparative Examples can give such images.

Copies obtained with the developers according to the present invention showed excellent image density and excellent image resolution, and were free of fogging.

The present invention provides an electrostatic developer comprising an electrically conductive magnetic toner and an insulating nonmagnetic toner, which is capable of giving fogging-free images having sufficient image density in a wide range of the electrically conductive magnetic toner/insulating nonmagnetic toner mixing ratio.

What is claimed is:

1. An electrostatic developer comprising a mixture of an electrically conductive magnetic toner and an insulating nonmagnetic toner, the electrically conductive magnetic toner being a toner which is formed by attaching or fixing a frictionally chargeable substance to a surface of a main electrically conductive magnetic toner component containing 30 to 70% by weight of a magnetic powder and which has a volume specific resistance of $1\times10^3\Omega$.cm or less, the frictionally chargeable substance being chargeable to have a polarity reverse to the polarity of the insulating nonmagnetic toner, the insulating nonmagnetic toner being a toner which is chargeable to have the same polarity as a polarity of the main electrically conductive magnetic toner component when the electrostatic developer is transferred to a photoconductive drum and which has a volume specific resistance of $1\times10^9\Omega$.cm or more.

2. A developer according to claim 1, wherein the electrically conductive magnetic toner and the insulating nonmagnetic toner are contained in a mixing weight ratio of 60:40 to 85:15.

3. A developer according to claim 1, wherein the frictionally chargeable substance is attached or fixed in an amount of 0.1 to 5 parts by weight per 100 parts by weight of the main electrically conductive magnetic toner component.

4. A developer according to claim 1, wherein the main electrically conductive magnetic toner component is composed mainly of a binder resin and a colorant.

5. A developer according to claim 1, wherein the electrically conductive magnetic toner has, further attached to a surface thereof, at least one member selected from the group consisting of an agent for imparting uniform electric conductivity and a fluidity improver.

6. A developer according to claim 1, wherein the insulating nonmagnetic toner is composed mainly of a binder resin, a colorant and a charge adjuster.

7. A developer according to claim 1, wherein the insulating nonmagnetic toner has, further attached to a surface thereof, at least one member selected from the group consisting of a resistance adjuster and a fluidity improver.

8. A developer according to claim 7, wherein said at least one member is attached in an amount of 0.05 to 1 part by weight per 100 parts by weight of the insulating nonmagnetic toner.

* * * * *